US007409957B2

(12) United States Patent
Abergel

(10) Patent No.: US 7,409,957 B2
(45) Date of Patent: Aug. 12, 2008

(54) DEVICE FOR DISPENSING AT LEAST TWO PRODUCTS, AND DISPENSING END-PIECE

(75) Inventor: Aline Abergel, Boulogne (FR)

(73) Assignee: L'Oreal, Paris (FR)

( * ) Notice: Subject to any disclaimer, the term of this patent is extended or adjusted under 35 U.S.C. 154(b) by 545 days.

(21) Appl. No.: 11/038,153

(22) Filed: Jan. 21, 2005

(65) Prior Publication Data

US 2005/0184091 A1 Aug. 25, 2005

Related U.S. Application Data

(60) Provisional application No. 60/539,585, filed on Jan. 29, 2004.

(30) Foreign Application Priority Data

Jan. 20, 2004 (FR) ..... 04 50103

(51) Int. Cl.
*A45D 24/22* (2006.01)
*B65D 35/22* (2006.01)
*A46B 11/00* (2006.01)

(52) U.S. Cl. ..... 132/114; 132/112; 401/44; 222/94

(58) Field of Classification Search ..... 132/112–116; 401/44, 47, 28; 222/94, 145.1, 145.5, 134
See application file for complete search history.

(56) References Cited

U.S. PATENT DOCUMENTS

| | | | | |
|---|---|---|---|---|
| 2,446,398 | A | 8/1948 | Wilson | |
| 2,819,723 | A | 1/1958 | Meyer | |
| 4,893,729 | A | 1/1990 | Iggulden et al. | |
| 5,088,849 | A * | 2/1992 | Johnson et al. | 401/44 |
| 6,012,462 | A | 1/2000 | Schmittou | |
| 6,402,841 | B1 * | 6/2002 | Vesterlund et al. | 118/315 |
| 6,877,924 | B1 * | 4/2005 | Mears et al. | 401/190 |
| 2003/0019883 | A1 | 1/2003 | De Laforcade | |
| 2003/0106905 | A1 | 6/2003 | Chan et al. | |
| 2003/0121936 | A1 | 7/2003 | De Laforcade | |
| 2005/0184091 | A1 | 8/2005 | Abergel | |

FOREIGN PATENT DOCUMENTS

| | | |
|---|---|---|
| EP | 0 875 460 | 11/1998 |
| FR | 2 647 093 | 11/1990 |
| FR | 2 735 105 | 12/1996 |
| FR | 2 774 072 | 7/1999 |
| JP | 11-342983 | 12/1999 |

OTHER PUBLICATIONS

U.S. Appl. No. 11/963,495, filed Dec. 21, 2007 Abergel.

* cited by examiner

*Primary Examiner*—Robyn Doan
(74) *Attorney, Agent, or Firm*—Oblon, Spivak, McClelland, Maier & Neustadt, P.C.

(57) ABSTRACT

A device is provided for packaging and applying at least two products, particularly hair-treatment products. The device includes a first compartment suitable for containing a first product, and a second compartment suitable for containing a second product. An applicator end-piece includes at least two orifices for dispensing the product, and the end-piece has an interior distributor dividing the flows of products emanating, respectively, from the compartments. The end-piece also includes a first orifice that dispenses a mixture or ratio of the first and second products in respectively different proportions from those of a mixture or ratio of these products dispensed by a second orifice.

63 Claims, 4 Drawing Sheets

DEVICE FOR DISPENSING AT LEAST TWO PRODUCTS, AND DISPENSING END-PIECE

CROSS REFERENCE TO RELATED APPLICATIONS

This document claims priority to French Application Number 04 50103, filed Jan. 20, 2004 and U.S. Provisional Application No. 60/539,585, filed Jan. 29, 2004, the entire contents of which are hereby incorporated by reference.

BACKGROUND OF THE INVENTION

1. Field of the Invention

The invention relates to an applicator end-piece suitable for dispensing at least two products. The end-piece can be particularly advantageous for applying hair dyes, in streaks, to the hair. The invention also provides an applicator end-piece operationally mounted on compartments or receptacles containing products to be distributed, to form a device for packaging and applying at least two products.

2. Discussion of Background

Assemblies are known that propose separate packaging for two products while dispensing them together, with a view to producing a composition, particularly a cosmetic composition, as used, for example, in the hair-dyeing field. This type of assembly allows the extemporaneous mixing of the two products (e.g., a dye and an oxidizing agent) that, for reasons of stability, are kept separate from one another until the dye composition is formed.

Examples of this type of assembly are described in documents US A 2003 0121936 and US A 2003 0019883.

U.S. Pat. No. 2,446,398 teaches end-pieces in the form of a comb that includes an interior channel opening out via a plurality of outlets, with the outlets provided between teeth of the comb. The channel of one such comb is fed with products to be dispensed by way of the mounting of the end-piece on a handle that includes a plurality of reservoirs respectively containing the products. One inlet of the channel, upstream of all the outlets, receives the flows of products emanating from each of the compartments. A mixture is then produced at each inlet of the channel and this homogeneous mixture is dispensed from the outlets.

Thus, when a user wishes to produce highlights in her hair, she can, using known, state-of-the-art devices, produce highlights using one and the same dye composition formed extemporaneously upstream or downstream of the dispensing end-piece and, in such cases, produce highlights of the same color in her hair. However, to provide variations in tone of these highlights it is necessary to very precisely control the respective periods of contact of the mixture on the various locks of hair. The production of gradations of highlights over an entire head of hair thus becomes extremely complex, particularly when the user is producing her own highlights. With these known devices it is, furthermore, practically impossible to simultaneously produce highlights in colors, not just in tints, that are different.

For highlights in colors, end-pieces are known that include a plurality of interior channels each opening out at a different outlet. For example, from the teachings of U.S. Pat. No. 6,012,462, a portable device is known, for example, in the form of a gun, that includes four receptacles that each include a different dye product. This assembly is put together such that each receptacle is in fluid communication with one or more channels of the comb so that each of the products contained in the receptacles is dispensed separately at at least one or even a plurality of separate orifices.

However, with a portable assembly of this type, the user who wishes to produce gradations of highlights must have purchased or herself prepared the dye compositions in the receptacles such that these compositions are of different tints but tints that are close to one another. Furthermore, the portable assembly will not enable her to widen the palette of colors that can be produced on her hair unless the structure of the assembly is modified, and the modified assembly would then include added-on receptacles and as many, if not more, supplementary dispensing orifices and channels.

SUMMARY OF THE INVENTION

There is a need, not satisfied by state-of-the-art devices, for a device that makes it possible to produce gradations of highlights in different tints without requiring the use of as many reservoirs as there are different tints to produce. There is also a need for a device that makes it possible easily to produce highlights of intermediate tints as compared with highlights that may be achieved directly using commercially available tints.

The device for packaging and applying at least two products, particularly hair-treatment products, according to the invention, aims to satisfy some and preferably all the above objectives. According to a preferred example, the device includes a first compartment suitable for containing a first product and a second compartment suitable for containing a second product. In addition, an applicator end-piece is provided which includes at least two orifices for dispensing the product, with the end-piece being mounted such that each orifice is in fluid communication with at least one of the compartments. Further, at least one of the dispensing orifices is in fluid communication with the first and second compartments. Moreover, the end-piece includes an interior distributor dividing the flows of products emanating, respectively, from the compartments, such that a first orifice dispenses a first mixture of first and second products in different proportions from those of a second mixture of these products dispensed by a second orifice.

The advantage of the invention is that it makes it possible to use a device of this type in order to dispense, for example, two hair-dye products and thus allow the application of a gradation of colors varying from a first color corresponding to the first, pure product to a second color, corresponding to the second, pure product. The dyeing achieved can thus have a more natural effect and may be obtained in a short time after the first application of the products.

According to preferred examples of the invention, it is possible to dispense, via the first orifice, a first, non-zero proportion of the flow of first product and a second, non-zero proportion of the flow of second product, with the complementary proportions of the flows of first and second products being dispensed via the second orifice.

By way of example, the proportion of one of the products of one of the two mixtures may be zero if desired.

Advantageously, and by way of example, the end-piece may include at least three orifices such that a first orifice is in fluid communication with the first receptacle only, a second orifice is in communication with the first and the second receptacle, respectively, and a third orifice is in communication with the second receptacle only. Three tints can thus be obtained emanating separately from the end-piece, whereas only two dyes are contained separately in the receptacles.

Preferably, the end-piece can include a chamber divided into at least two zones by the distributor, with inlets respectively connected to the receptacles and feeding these zones, and outlets in communication with a dispensing orifice, and with each zone including at least one outlet. By way of example, a first zone may include at least two outlets of different sections, with each of these two outlets opening out in a separate orifice. Also, by way of example, a second zone may include at least two outlets of different sections and of different relative proportions from the relative proportions of the two outlets of different sections of the first zone, and with each of these two outlets opening out in a separate orifice.

For example, the inlets may open out at a lower face of the chamber, with outlets provided on an upper face of the chamber. According to this example, the distributor may extend at least partially orthogonally to the lower face. Still according to this example, and as a complement or additional option, the distributor may also extend at least partially orthogonally to the upper face.

According to a particular example of an embodiment of the invention, the chamber can be parallelepipedal with the distributor extending along a diagonal of the parallelepiped.

Advantageously, the end-piece may include teeth arranged, for example, so as to form a comb. In this case, one of the orifices may open out in a hollow formed between two teeth. In a variant embodiment, an orifice may open out in an end portion of a tooth. Further, by way of example, the orifice may open out laterally relative to the end portion of a tooth, towards a space defined between two adjacent teeth. Preferably, the compartments each have a main extension axis, with these axes being, in particular, parallel to one another, such that the teeth extend either parallel to or in a surface that is secant, and preferably perpendicular, to at least one of the main extension axes.

According to another example, the device may include an assembly within which the two receptacles are placed, such that the end-piece is retained on this assembly in communication with the receptacles.

Advantageously, the receptacles can be arranged for dispensing the products they contain. For example, one of the receptacles can include manually compressible walls so as to allow the exit of the product it contains into the end-piece, through the effect of a force applied over an outer periphery of these walls. In a variant embodiment, one of the receptacles can include a piston arranged in a bottom of the receptacle, the rise of which piston in the receptacle allows the end-piece to be fed with product. Advantageously, both receptacles can be equipped with a piston, which makes it possible to dispense the products in a repetitive, identical manner in both zones.

In a further preferred example, the first product is a first hair dye and the second product is a second hair dye different from the first hair dye, with the two products being intended for application to the hair.

If appropriate, the end-piece may include at least three inlets for connection, respectively, to at least three receptacles. In this case, the chamber may be divided into three zones by the distributor, with each of the zones being fed, respectively, by one inlet. In a variant, the end-piece includes three inlets opening out in two zones such that a first zone receives all the first product and a proportion of the second product, whereas the second zone receives all the third product and the complementary proportion of the second product.

The invention also provides an applicator end-piece suitable for dispensing at least two products, with the end-piece including a chamber divided into at least two zones by an interior distributor, and with the zones being fed with the products via supply inlets. Each zone includes at least one outlet, with the end-piece including at least two dispensing orifices, each in fluid communication with at least one outlet. In addition, according to a preferred example, at least one of the dispensing orifices is in fluid communication with two zones. Moreover, the interior distributor is arranged such that the flow of products arriving, respectively, via the inlets is divided via the outlets such that a first orifice dispenses a first mixture of first and second products in different proportions from those of a second mixture of these products dispensed by a second orifice. By way of example, a first zone can include two outlets, whereas a second zone can include one outlet.

Advantageously, the end-piece can include three dispensing orifices. In a variant embodiment, the end-piece may include a plurality of dispensing orifices.

For example, a first ratio of a section (or cross-sectional area) of a first outlet in communication with a first zone to a section (or cross-sectional area) of a second outlet in communication with a second zone, with this first outlet and this second outlet feeding one and the same first dispensing orifice, is preferably different from a second ratio of a section of a third outlet in communication with the first zone to a section of a fourth outlet in communication with the second zone, with this third outlet and this fourth outlet feeding a second dispensing orifice different from the first dispensing orifice. Even according to this example, an outlet may be closed off and thus effectively have a zero cross-section. In this case, the ratios of sections may have a finite or non-finite value.

Advantageously, a first zone includes at least two outlets of different sections, with each of these two outlets opening out in separate orifices. In this case, a second zone may include at least two outlets of different sections and of different relative proportions from the relative proportions of the two outlets of different sections of the first zone, with each of these two outlets opening out in separate orifices.

According to a particular example of an embodiment, the inlets open out at a lower face of the chamber, and outlets are provided on an upper face of this chamber. The distributor then preferably extends at least partially orthogonally to the lower face and, possibly, at least partially orthogonally to the upper face. More particularly, the chamber may be parallelepipedal and, in this case, the distributor preferably extends along a diagonal of the parallelepiped.

Advantageously, the end-piece may include teeth arranged, for example, so as to form a comb. In this case, one of the orifices may open out in a hollow formed between two teeth. In a variant, an orifice may open out in an end portion of a tooth. In addition, by way of example, the orifice may open out laterally relative to the end portion of a tooth, towards a space defined between two adjacent teeth.

As a variant embodiment, the end-piece may include at least three inlets in order to be mounted, respectively, on at least three receptacles, with these inlets opening out in a chamber divided into at least three zones by the distributor, and with each of the zones being fed, respectively, by one inlet.

BRIEF DESCRIPTION OF THE DRAWINGS

The invention will become further apparent from the following detailed description, particularly when considered in conjunction with the drawings in which.

DETAILED DESCRIPTION OF THE PREFERRED EMBODIMENTS

Figure 1:
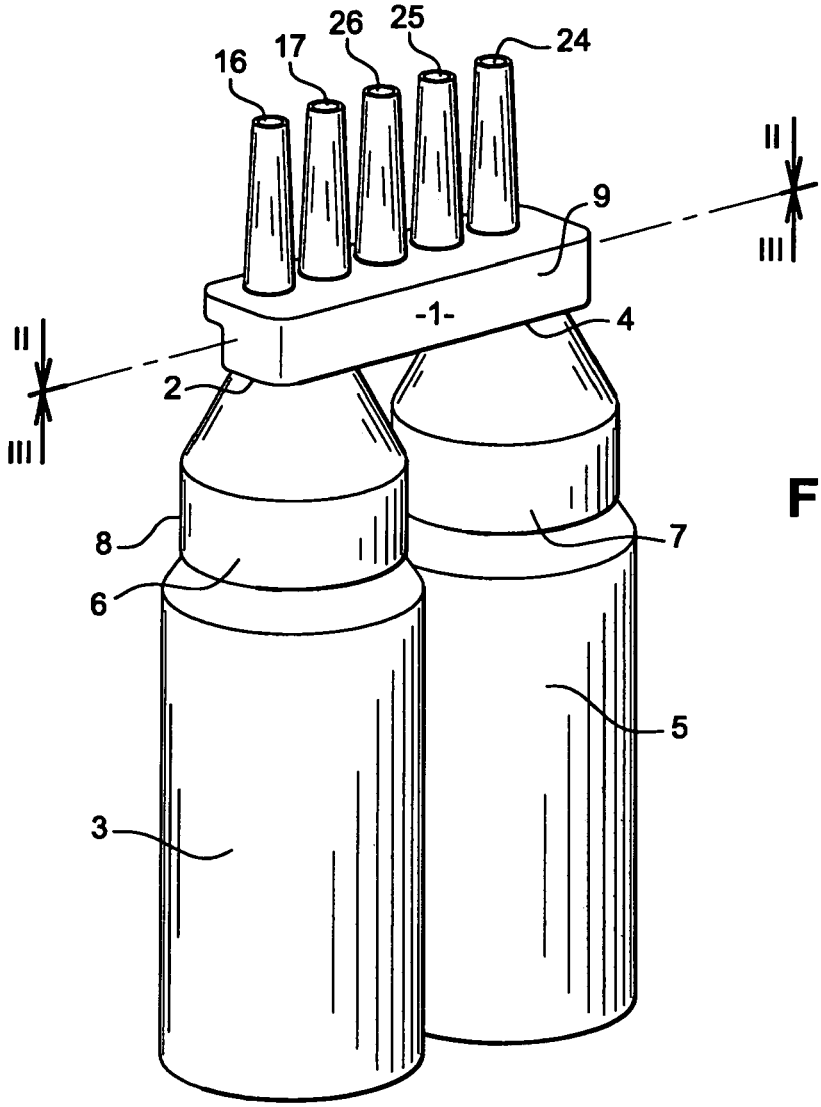
FIG. 1 is an overall perspective view of a device according to the invention.

FIG. 1 shows a dispensing end-piece 1 including a first inlet 2 mounted on a first receptacle or compartment 3 and including a second inlet 4 mounted, respectively, on a second receptacle or compartment 5. The receptacles 3 and 5 include openings 6 and 7, respectively, such that the first opening 6 is in fluid communication with the first inlet 2, whereas the second opening 7 is in fluid communication with the second inlet 4. Preferably, the end-piece 1 is mounted in a leaktight manner on these receptacles.

The receptacles 3 and 5 contain products, preferably differing from one another, which may be supplied via the openings 6 and 7 into the end-piece 1. For example, the receptacles can include a suitable expedient for entraining the exit of the products towards the end-piece 1.

According to a first variant embodiment, at least one wall of a receptacle is flexible and may be pushed in manually so as to create an excess pressure in the enclosure of the receptacle and thus give rise to the exit of the product. In the example presented, the receptacles 3 and 5 are side by side. In this case, and according to the first variant embodiment, the two receptacles are thus preferably identical and form, for example, two flasks or bottles with flexible side walls.

According to a second variant embodiment, the receptacle can cause the exit of the product it contains by using, for example, a piston, provided or not provided with a device for entraining or moving the piston from outside the receptacle. It is to be understood that other suitable expedients can be used for urging or drawing the product from the receptacles to the end-piece.

Further, by way of example, the two receptacles or compartments 3 and 5 may correspond to two compartments formed in one and the same assembly and, in this case, the end-piece can be mounted directly on the assembly.

In FIG. 1, the two receptacles 3 and 5 are identical and cylindrical and the openings 6 and 7 are defined orthogonally to the extension axis of these cylinders. The inlet 2 of the end-piece is extended by a channel having a variable section in order to have an end 8 suitable for mounting in a leaktight manner on the first opening 6, whereas the inlet 2 is defined at the opposite end of this channel and can thus have a different section. For example, the second inlet 4 is connected in the same manner to the second opening 7.

The inlets 2 and 4 of the end-piece 1 open out in a chamber 9 of the end-piece 1. This chamber 9 has an interior structure which makes it possible to keep the flows of products arriving, respectively from the two receptacles via the inlets 2 and 4, separate. In the illustrated example, the structure includes a distributor 10 (FIG. 2) in the form of a partition dividing the space of this chamber into two zones 11 and 12 such that an inlet opens out in a single zone. In the illustrated example, the first inlet 2 opens out in the first zone 11 and the second inlet 4 opens out in the second zone 12.

Figure 2:
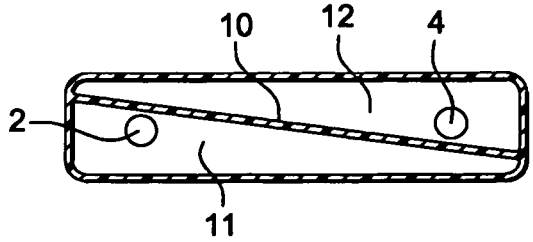
FIG. 2 is a diagrammatic transverse sectional view along II-II of FIG. 1.

According to the example illustrated in FIG. 2, the chamber 9 overall has a parallelepipedal shape and the distributor 10 extends along a diagonal of the face having the two inlets 2 and 4. The inlets are preferably arranged close to the base of the triangular section of their respective zone, partly delimited by the distributor 10. The location of this inlet is defined such that, when the zone is fed with product, the product is able to flow into the entire space of this zone, expelling any air present in the zone.

Each zone includes at least one outlet for allowing the product to exit as far as the dispensing orifices of the end-piece. In the illustrated example, the first zone 11 includes a first outlet 13 and a second outlet 14. The outlet 13 is connected by a first channel 15 (FIG. 3) to a first dispensing orifice 16, whereas the second outlet 14 is connected independently via a second channel 19 to a second dispensing orifice 17. Furthermore, the second zone 12 itself also includes an outlet 18, with this outlet 18 opening out in the second channel 19 leading to the second dispensing orifice 17, whereas this same second zone 12 includes no outlet enabling it to open out in the first channel 15 leading to the first dispensing orifice 16. Thus, the first dispensing orifice 16 delivers the product contained in the first receptacle 3, whereas the second dispensing orifice 17 delivers a mixture of the products of the two receptacles, with the mixture of the products taking place, in particular, in said second channel 19.

The first orifice 16 thus dispenses a proportion of 100% of the first product and none of the second product, whereas the second orifice 17 dispenses non-zero proportions of each of the two products. The proportion of the two products dispensed by this second orifice 17 depends on the proportion in which the second channel 19 is fed with each of two products.

Figure 3:
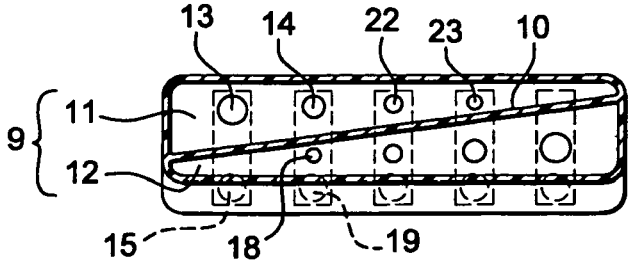
FIG. 3 is a diagrammatic transverse sectional view along III-III of FIG. 1.

Considering the view of FIG. 3 as diagrammatic, by way of example, it may be seen that the visible sections of the outlets 14 and 18 are equal to the sections of the arrival openings 20 and 21, respectively, in the second channel 19. Furthermore, this situation corresponds to that shown in FIG. 4. In this case, the respective proportions of the products are correlated directly with these respective sections. The proportion of first product exiting via the second orifice 17 corresponds to the ratio of the section of the outlet 14 to the sum of the sections of the outlets 14 and 18, with the complementary proportion corresponding to the second product.

However, in a variant embodiment, provision may be made for an outlet such as 14 and/or 18 to open out in an intermediate channel of variable section in order later to open out in the channel 19. In this case, therefore, in order to determine the future proportion of the product dispensed it is necessary to consider the smallest of the sections of the intermediate channel between the outlet and the arrival opening.

In all cases, with an end-piece according to the invention and such an interior distributor 10, it is possible to deliver mixtures in all or varying proportions of the two products supplying, respectively, the two zones 11 and 12.

Preferably, the end-piece 1 includes more than two dispensing orifices. For example, according to FIGS. 1 to 4, the end-piece 1 includes five orifices such as the orifices 16 and 17. According to the example shown, an orifice is at most fed by two orifices each originating from a different zone.

For example, the end-piece 1 includes a plane of symmetry such that each zone includes as many outlets, with the outlets of one zone being symmetrical with that of the other zone. More precisely, the first zone 11 includes a third outlet 22 and a fourth outlet 23. In a symmetrical manner, the second zone 12 then includes, also, four outlets, i.e. three outlets in addition to the outlet 18. These outlets are arranged such that the orifices furthest away from one another of the end-piece distribute solely and respectively one of the products and such that the three orifices arranged between these distant orifices dispense mixtures of these two products.

According to the example of FIGS. 1 to 4, the dispensing orifice 16 preferably has, for symmetry, a dispensing orifice 24, these two orifices being the furthest from one another. The dispensing orifice 17 has, for the purposes of symmetry, a dispensing orifice 25 and the last dispensing orifice 26 of the five orifices provided is preferably defined on the axis of symmetry. The dispensing orifice 17 dispenses a proportion A of the first product and a complementary proportion of second product. In this way, the symmetrical orifice 25 dispenses a proportion A of the second product for a complementary proportion of said first product. According to the embodiment, by way of example, the central dispensing orifice 26 dispenses a 50/50 mixture of first and second product.

Obviously, any other internal configuration of the end-piece also falls within the scope of the present invention, irrespective of the number of orifices provided in excess of two. Furthermore, by adapting the dimensions and number of outlets provided per zone, it is possible to achieve an almost infinite number of variants of end-piece arrangements according to the invention. Thus, it is to be understood that variations in, for example, the sizing, arrangement, and proportions of the various apertures and conduits, can be used in accordance with the present invention. In a variant embodiment, the position of the distributor 10 inside the chamber 9 may also make it possible to dispense any product whatsoever at any orifice whatsoever. Thus, while the invention is particularly advantageous for hair products such as hair dye products, it is to be understood that the invention can also be used for other products.

It is thus possible to dispense as many different mixtures of two products as there are different dispensing orifices, each orifice being fed with these two products in individual and thus possibly different proportions. As an option, provision may be made to close off some of the dispensing orifices, if certain proportions of mixtures are not desired.

Figure 4:
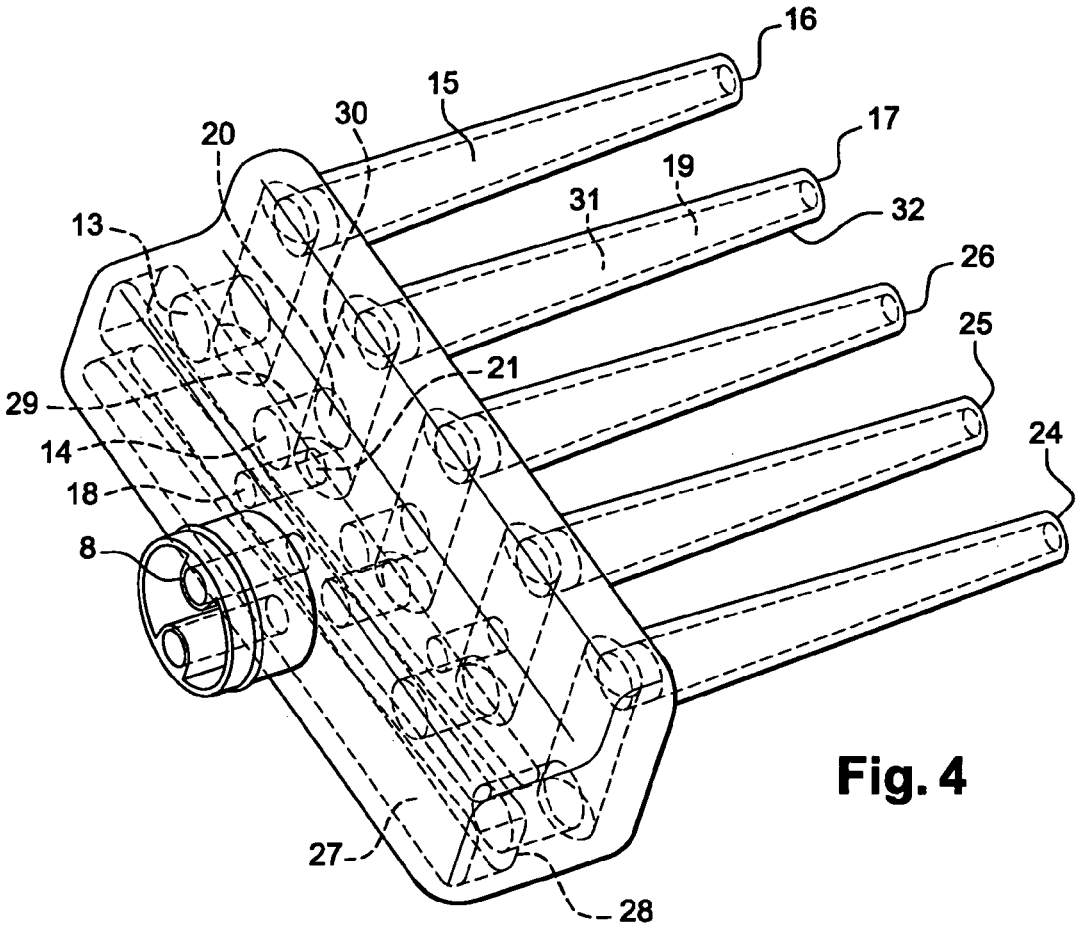
FIG. 4 is a perspective, see-through or fantom view of an end-piece according to an example of the invention according to a particular embodiment.
Figure 5:
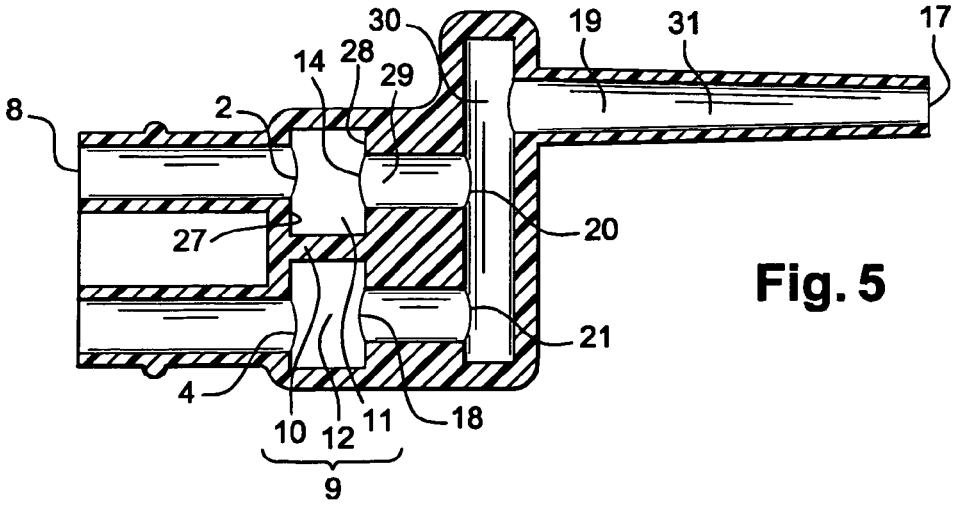
FIG. 5 is a longitudinal cross-sectional view of an end-piece according to FIG. 4.

In FIGS. 4 and 5, according to a particular embodiment or example, the chamber 9 is parallelepipedal, and the inlets 2 and 4 are defined at a lower face 27. As may be seen in FIG. 4, these inlets open out such that the flows of product arrive orthogonally to this lower face 27 inside the chamber 9. The outlets 13, 14 and 18 are defined at an upper face 28, opposite the lower face 27. The distributor 10 forms a partition extending along the respective diagonals of this lower face 27 and of this upper face 28. Preferably, the distributor 10 extends along mutually parallel diagonals of these two faces.

In particular, by way of example, the outlets of the zones are extended via intermediate channels such as 29, extending orthogonally to the upper face 28 in order to open out in a first portion 30 of a channel such as 15 or 19. This first portion 30 extends orthogonally to the intermediate channel 29 and thus parallel to the upper face 28. This first portion 30 is extended by a second portion 31 of said channel such as 15 or 19, where the dispensing orifice such as 16, 17, 24, 25 or 26 is defined.

In the example embodiments shown in FIGS. 1 to 7, the channels such as 15 or 19 include an elbow. In particular, they all have elbows at the same angle so as to present their dispensing orifice respectively aligned in accordance with one or more rows. The second portion 31 then extends, in the examples, orthogonally to the first portion 30. It is then defined in the extension of the respective main extension axes of the two receptacles.

In a variant embodiment, the second portion 30 includes a supplementary elbow or piece across this portion forming a mixer obstacle. The mixer obstacle, for example in the form of a helix, or a supplementary elbow, help to create turbulences or disturbances or obstructions in the flow of the products inside the channel. These turbulences help to produce a homogeneous mixture of the two products such that the products are intimately mixed when they exit at the dispensing orifice.

Figure 8:
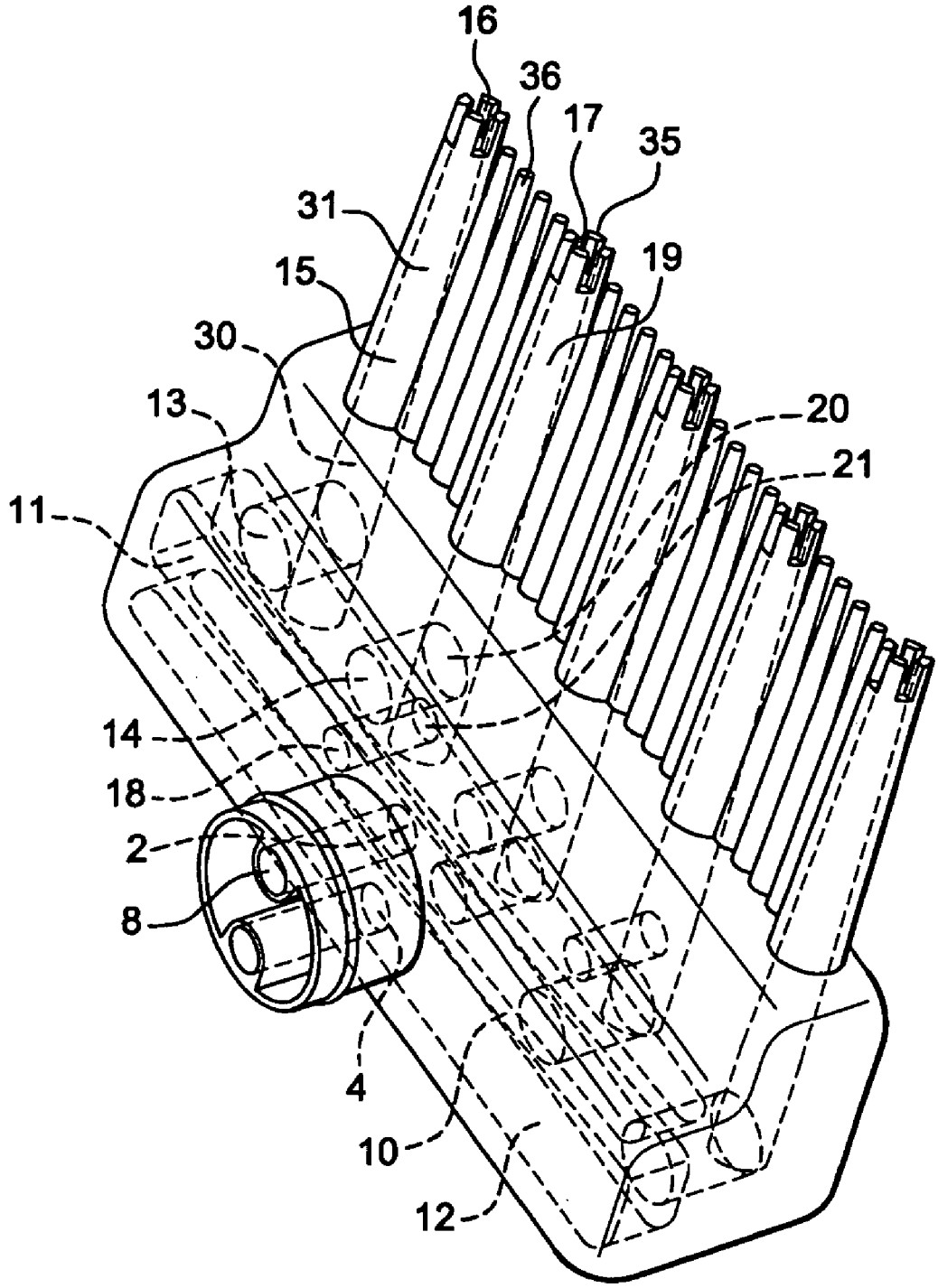
FIG. 8 is a perspective, see-through or fantom view of an end-piece according to the invention, according to a further example of a particular embodiment.

Alternatively, by way of further example, according to the embodiment of FIG. 8, the channels such as 15 or 19 are rectilinear and the first portion 30 extends in the second portion 31, which is collinear therewith. The second portion 31 is thus secant with the respective main extension axes of the two receptacles, which facilitates handling of such a device provided with such an end-piece. In particular, in the illustrated example the second portion is perpendicular to the axes of the receptacles.

In the example shown in FIG. 4, the second portion 31 of a channel such as 19 extends preferably inside a tooth 32 extending from the outer periphery of the end-piece. Preferably, each channel extends inside a different tooth. Thus, the end-piece includes a series of teeth arranged, for example, in order to form a comb.

Figure 6:
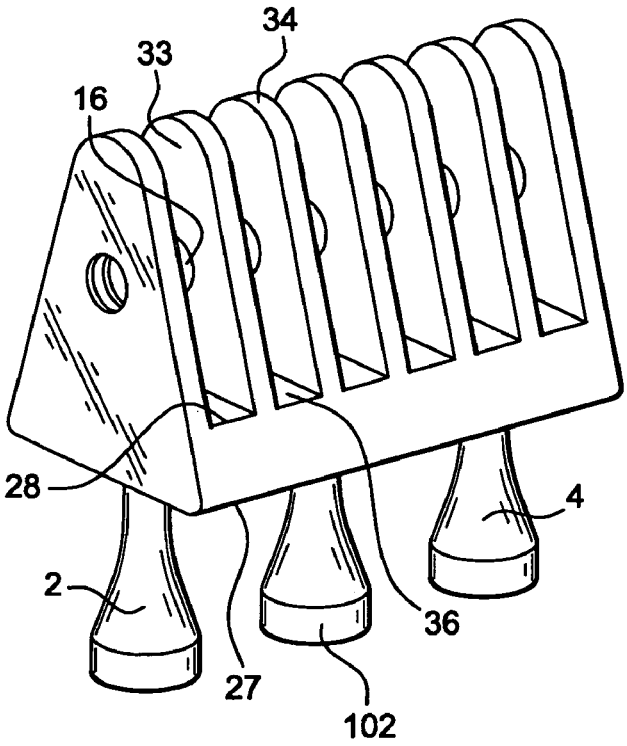
FIG. 6 is a profile or perspective view of a first variant embodiment of an end-piece according to an example of the invention.
Figure 7:
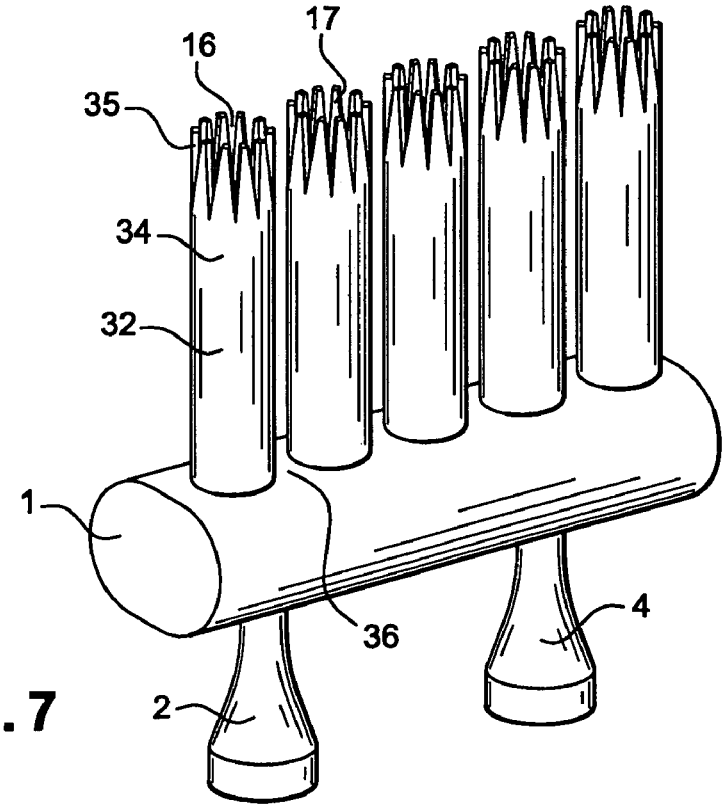
FIG. 7 is a profile or perspective view of a second variant embodiment of an end-piece according to an example of the invention.

The teeth of such a comb form blades in FIG. 6, whereas, in FIG. 7, the teeth are in the form of tubular spikes. In FIG. 6, a blade includes a dispensing orifice such as 16 defined at a wall 33 of the outer periphery of the blade. The dispensing orifice 16 is preferably defined at a distance from the borders of this wall and opens out, therefore, in a space defined between two juxtaposed blades. In the illustrated arrangement, by way of example, the blades are arranged parallel with one another so as to form the comb. Given the width of the blades, when such a comb is passed through the hair, a lock of hair is caught between two blades and spread out in order to form a flat surface. The dispensing orifice thus opens out on a part of the lock of hair caught between these two blades or teeth. It is thus possible to produce a web of fine locks of hair using a comb that is, moreover, easy to handle.

In a variant embodiment (FIG. 7), the dispensing orifices such as 16 and 17 are defined in the extension axis of the teeth and open out, respectively, at an end portion 34 of the second portion 31. Optionally, each dispensing orifice can be surrounded with small spikes 35 delimiting the dispensing orifice and extending in accordance with the main extension axis of each of the teeth such as 32. These spikes 35 may be obtained, for example, by injection in a single piece together with the tooth 32 that carries them. Preferably, the spikes are narrow in order to be flexible and thereby facilitate spreading of the product over the lock of hair caught in these spikes 35. Thus, fine locks of hair may also be caught in these spikes, defining the width of the highlights that may be achieved. These spikes help to impregnate the mixture of products dispensed by the dispensing orifice onto the lock of hair caught in the spikes. Alternatively, according to an example that is not shown, the orifices may be defined in a hollow 35 opening out between two teeth of a comb.

According to the variant embodiment presented in FIG. 8, the end-piece 1 includes teeth such as 32 whose dispensing orifice is, respectively, delimited by an arrangement of spikes such as 35. In this example, the teeth are arranged such that they define a row so that, between at least two consecutive teeth, an arrangement of teeth such as 36 is presented. This arrangement of teeth such as 36 includes no dispensing orifice—it is provided in order to allow covering of the hairs arranged between two locks of hair coated via the dispensing orifices.

Preferably, the free ends of the teeth such as 36 are in line with the free ends of the spikes such as 35. Thus, the depth at which hairs may be caught between two teeth such as 36 is greater than the depth defined between two spikes such as 35. When the end-piece 1 is moved along the hair, a first curtain formed of locks of hair selected for coating is placed in a different plane from the plane of extension of the curtain formed by the mass of hair not to be coated and caught in the teeth such as 36. The locks of hair are thus better separated from the rest of the hair.

The spacing between the locks of hair produced is a function of the spacing provided between the teeth. The closer the teeth are to one another, the more packed the locks of hair will be. For example, the teeth may be packed to such an extent that they make it possible to produce mutually juxtaposed highlights without intermediate locks of hair that are not coated with product. This provides a continuous web of gradations. In a variant embodiment, and in order to obtain a more natural effect, the spacing between two consecutive teeth can be such that it is not constant.

In particular, according to the example of FIG. 7, the chamber 9 is defined inside a cylinder. Any other structure may also be envisaged.

According to the example of FIG. 6, the end-piece may be connected to three reservoirs and may thus be fed with three different products. In this example, the end-piece includes a third inlet 102. For example, the three products are then mixed in two zones, in which case one of the three products can feed the two zones, the two others feeding, respectively, one zone each. Alternatively, the chamber may be divided into three different zones by a distributor of suitable shape, each product feeding, respectively, one zone. It is thus possible to dispense even more different mixtures from these three products. It is even possible to obtain a rainbow effect by multiplying the number of zones defined in the chamber, with each zone being fed at least with one product different from those feeding the adjacent zones.

Throughout the description, expressions such as "including a" (or "including one"), "having a," or "comprising a" and similar expressions for numbers greater than one, must be understood as being synonymous with "including at least one" (or at least two, etc.) unless specified otherwise.

Obviously, numerous modifications and variations of the present invention are possible in light of the above teachings. It is therefore to be understood that, within the scope of the appended claims, the invention may be practiced otherwise than as specifically described herein.

What is claimed as new and desired to be secured by Letters Patent of the United States is:

1. A device for packaging and applying at least two products, including a first compartment suitable for containing a first product, a second compartment suitable for containing a second product, and an applicator end-piece including at least two dispensing orifices for dispensing the product, and wherein the end-piece is mounted such that each dispensing orifice is in fluid communication with at least one of the first and second compartments;

wherein:

(i) at least one of the dispensing orifices is in fluid communication with the first and second compartments, and (ii) the end-piece includes an interior distributor dividing the flows of products emanating, respectively, from the first and second compartments, such that a first dispensing orifice dispenses a first ratio of first and second products in different proportions from those of a second ratio of these products dispensed by a second dispensing orifice.

2. A device according to claim 1, wherein the proportion of one of the products of one of the first and second ratios is zero.

3. A device according to claim 2, wherein the end-piece includes at least three dispensing orifices such that a first dispensing orifice is in fluid communication with the first receptacle only, a second dispensing orifice is in communication with the first receptacle and the second receptacle, and a third dispensing orifice is in communication with the second receptacle only.

4. A device according to claim 3, wherein the end-piece includes a chamber divided into at least a first zone and a second zone by the distributor, and wherein the end-piece includes inlets respectively connected to the receptacles and feeding the first and second zones, and wherein each zone includes at least one outlet in communication with a dispensing orifice.

5. A device according to claim 1, wherein the end-piece includes a chamber divided into at least a first zone and a second zone by the distributor, and wherein the end-piece includes inlets respectively connected to the receptacles and feeding the first and second zones, and wherein each zone includes at least one outlet in communication with a dispensing orifice.

6. A device according to claim 5, wherein the first zone includes at least two outlets having different cross-sections, and wherein each of these two outlets is in communication with a different dispensing orifice.

7. A device according to claim 6, wherein a second zone includes at least two outlets having different cross-sections and wherein each of these two outlets is in communication with a different dispensing orifice.

8. A device according to claim 5, wherein the inlets open out at a lower face of the chamber, and wherein the outlets are positioned at an upper face of the chamber.

9. A device according to claim 8, wherein the distributor extends at least partially orthogonally to the lower face.

10. A device according to claim 9, wherein the distributor extends at least partially orthogonally to the upper face.

11. A device according to claim 10, wherein the chamber is parallelepipedal and the distributor extends along a diagonal of the parallelepiped.

12. A device according to claim 5, wherein the chamber is parallelepipedal and the distributor extends along a diagonal of the parallelepiped.

13. A device according to claim 12, wherein the end-piece includes teeth.

14. A device according to claim 1, wherein the end-piece includes teeth.

15. A device according to claim 14, wherein the teeth are arranged to form a comb.

16. A device according to claim 14, wherein at least one of the dispensing orifices opens out in a hollow formed between two teeth.

17. A device according to claim 14, wherein at least one of the dispensing orifices opens out in an end portion of a tooth.

18. A device according to claim 17, wherein the at least one of the dispensing orifices opens out laterally relative to the end portion of a tooth and towards a space defined between two adjacent teeth.

19. A device according to claim 14, wherein the first and second compartments each have a main extension axis, and wherein the teeth extend parallel to at least one of the main extension axes.

20. A device according to claim 14, wherein the first and second compartments each have a main extension axis, and wherein the teeth extend in a surface that is secant to at least one of the main extension axes.

21. A device according to claim 20, wherein the teeth extend perpendicular to at least one of the main extension axes.

22. A device according to claim 1, wherein the device includes an assembly inside of which the first and second compartments are positioned such that the end-piece is retained on this assembly in communication with the first and second compartments.

23. A device according to claim 1, further including a supply of the first product in the first compartment and a supply of the second product in the second compartment, wherein the first product is different than the second product, and wherein the first and second products are hair products.

24. A device according to claim 23, wherein the first and second compartments include means for dispensing products contained therein.

25. A device according to claim 23, wherein one of the first and second compartments includes manually compressible walls so as to cause the product it contains to be fed into the end-piece through the effect of a force applied over an outer periphery of these walls.

26. A device according to claim 23, wherein one of the first and second compartments includes a piston arranged in a bottom of the compartment, such that movement of the piston causes the end-piece to be fed with product.

27. A device according to claim 23, wherein the first product is a first hair dye and the second product is a second hair dye.

28. A device according to claim 1, further including a third compartment and wherein the end-piece includes at least three inlets for connection, respectively, to the first, second and third compartments.

29. A device according to claim 28, wherein the at least three inlets open out in a chamber divided into at least three zones by a distributor, and wherein each of the zones is fed, respectively, by one inlet.

30. A device according to claim 1, wherein the first dispensing orifice dispenses the first ratio of the first and second products with non-zero amounts of said first and second products, and wherein the second dispensing orifice dispenses the second ratio of the first and second products with non-zero amounts of said first and second products, and wherein a ratio of the amount of the first product to the amount of the second product for the first ratio is different than that of the second ratio.

31. A device according to claim 30, further including a further dispensing orifice which dispenses said first product without any of said second product.

32. A device according to claim 31, further including a still further dispensing orifice which dispenses said second product without any of said first product.

33. A device according to claim 1, wherein said first ratio includes said first product without any of said second product and said second ratio includes non-zero amounts of said first and second products, and wherein the device further includes a third dispensing orifice which dispenses said second product without any of said first product.

34. An applicator end-piece suitable for dispensing at least two products, said end-piece including:

a chamber divided into at least a first zone and a second zone by an interior distributor, the zones being fed with said products via supply inlets;

at least one outlet associated with each of said first and second zones;

at least two dispensing orifices, each in fluid communication with at least one outlet;

wherein:

(i) at least one of the dispensing orifices is in fluid communication with said first and second zones, and (ii) the interior distributor is arranged such that the flow of products arriving, respectively, via the inlets is divided via the outlets such that a first dispensing orifice dispenses a ratio of first and second products in different proportions from those of a ratio of these products dispensed by a second dispensing orifice.

35. An end-piece according to claim 34, wherein the first zone includes two outlets and in that the second zone includes one outlet.

36. An end-piece according to claim 34, wherein the end-piece includes three dispensing orifices.

37. An end-piece according to claim 34, wherein a first ratio of a section of a first outlet in communication with the first zone to a section of a second outlet in communication with the second zone, this first outlet and this second outlet feeding a first dispensing orifice, is different from a second ratio of a section of a third outlet in communication with the first zone to a section of a fourth outlet in communication with the second zone, this third outlet and this fourth outlet feeding a second dispensing orifice different from the first dispensing orifice.

38. An end-piece according to claim 34, wherein at least one of the outlets is closeable to effectively have a zero cross-section.

39. An end-piece according to claim 34, wherein the first zone includes at least two outlets of different cross-sections, and wherein these two outlets communicate with separate dispensing orifices.

40. An end-piece according to claim 39, wherein the second zone includes at least two outlets of different cross-sections and wherein these two outlets communicate with separate dispensing orifices.

41. An end-piece according to claim 40, wherein a first outlet of the first zone and a first outlet of the second zone communicate with a first dispensing orifice, and wherein a second outlet of the first zone and a second outlet of the second zone communicate with a second dispensing orifice, and wherein a ratio of a cross-sectional area of the first outlet of the first zone to a cross-sectional area of the first outlet of the second zone is different from a ratio of a cross-sectional area of the second outlet of the first zone to a cross-sectional area of the second outlet of the second zone.

42. An end-piece according to claim 34, wherein the inlets open out at a lower face of the chamber, and wherein the at least one outlet of each zone is positioned on an upper face of the chamber.

43. An end-piece according to claim 42, wherein the distributor extends at least partially orthogonally to the lower face.

44. An end-piece according to claim 43, wherein the distributor extends at least partially orthogonally to the upper face.

45. An end-piece according to claim 44, wherein the chamber is parallelepipedal and the distributor extends along a diagonal of the parallelepiped.

46. An end-piece according to claim 34, wherein the chamber is parallelepipedal and the distributor extends along a diagonal of the parallelepiped.

47. An end-piece according to claim 34, wherein the end-piece includes teeth arranged to form a comb.

48. An end-piece according to claim 47, wherein at least one of the dispensing orifices opens out in a hollow formed between two teeth.

49. An end-piece according to claim 47, wherein at least one of the dispensing orifices opens out in an end portion of a tooth.

50. An end-piece according to claim 49, wherein the at least one of the dispensing orifices opens out laterally relative to the end portion of a tooth and towards a space defined between two adjacent teeth.

51. An end-piece according to claim 34, wherein the end-piece includes at least three inlets in order to be mounted, respectively, on at least three receptacles and in that these inlets open out in a chamber divided into at least three zones by the distributor, and wherein each of the zones is fed, respectively, by one inlet.

52. An end-piece according to claim 34, in combination with a first receptacle and a second receptacle to form a packaging and dispensing device, and wherein the first and second receptacles respectively contain first and second hair products, wherein the first hair product is different than the second hair product, and further wherein the supply inlets of said end-piece include a first inlet which receives the first hair product and a second inlet which receives the second hair product.

53. A device according to claim 52, wherein the first dispensing orifice dispenses said first hair product without any of said second hair product.

54. A device according to claim 53, wherein said second dispensing orifice dispenses non-zero amounts of both said first and second hair products.

55. A device according to claim 54, further including a third dispensing orifice which dispenses non-zero amounts of both said first and second hair products in different proportions than said second dispensing orifice.

56. A device according to claim 55, further including a fourth dispensing orifice which dispenses said second hair product without any of said first hair product.

57. A device according to claim 54, further including a third dispensing orifice which dispenses said second product without any of said first hair product.

58. A device according to claim 52, wherein the first and second dispensing orifices each dispense non-zero amounts of each of the first and second hair products.

59. A device according to claim 5, wherein said at least two products are hair treatment products.

60. A device according to claim 59, wherein said first and second ratios each include a mixture that includes both of said first and second products.

61. A device according to claim 1, wherein at least one of said first and second ratios includes a mixture that includes both of said first and second products.

62. A device according to claim 34, wherein the ratios dispensed by the first and second dispensing orifices each include a mixture that includes both of said first and second products.

63. A device according to claim 34, wherein at least one of the ratios includes a mixture that includes both of said first and second products.

* * * * *